US007318571B2

(12) United States Patent
Linssen

(10) Patent No.: US 7,318,571 B2
(45) Date of Patent: Jan. 15, 2008

(54) FIXATION MEMBER CONSISTING OF ELASTIC MATERIAL

(75) Inventor: Petrus Johannes Antonius Linssen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 249 days.

(21) Appl. No.: 10/537,596

(22) PCT Filed: Nov. 4, 2003

(86) PCT No.: PCT/IB03/05040

§ 371 (c)(1),
(2), (4) Date: Jun. 6, 2005

(87) PCT Pub. No.: WO2004/053389

PCT Pub. Date: Jun. 24, 2004

(65) Prior Publication Data

US 2006/0032995 A1 Feb. 16, 2006

(30) Foreign Application Priority Data

Dec. 9, 2002 (EP) ..... 02080159

(51) Int. Cl.
*A47B 96/00* (2006.01)

(52) U.S. Cl. ..... 248/222.12; 248/27.3; 439/36

(58) Field of Classification Search ..... 248/694, 248/222.12, 220.21, 27.3; 411/508, 913; 439/34, 36, 558, 557, 555; 24/591.1, 594.1, 24/628, 629, 630, 652, 664
See application file for complete search history.

(56) References Cited

U.S. PATENT DOCUMENTS

| | | | | |
|---|---|---|---|---|
| 4,920,618 | A * | 5/1990 | Iguchi | 24/453 |
| 5,511,283 | A * | 4/1996 | Hirose | 16/8 |
| 5,806,152 | A * | 9/1998 | Saitou et al. | 24/662 |
| 6,216,986 | B1 * | 4/2001 | Kwilosz | 248/74.1 |
| 6,276,812 | B1 * | 8/2001 | Helbig et al. | 362/655 |
| 6,386,496 | B1 * | 5/2002 | Lai et al. | 248/309.1 |
| 6,752,642 | B2 * | 6/2004 | Ushiro et al. | 439/248 |
| 6,804,864 | B2 * | 10/2004 | Kirchen et al. | 24/297 |

* cited by examiner

*Primary Examiner*—Carl D. Friedman
*Assistant Examiner*—Bradley H Duckworth

(57) ABSTRACT

A fixation member, made of a single piece of elastic material, used for mounting an object to a frame, and in particular for mounting an automotive lamp in a reflector housing, includes a first portion and a second portion interconnected by first spring means. The first portion comprise first catch means for engaging with a frame to which the fixation member is to be fixed after the first portion is pushed towards the second portion, while the first spring means pushes the second portion against the frame. The first portion furthermore comprises second catch means for engaging with corresponding catch means of the second portion when the first portion is pushed further towards said second portion against an increasing force of the first spring means, whereby the catch means retracts and thereby disengages from the frame. The second portion is provided with second spring means for abutting against the frame thereby pushing the second portion in a direction away from the frame.

13 Claims, 3 Drawing Sheets

FIXATION MEMBER CONSISTING OF ELASTIC MATERIAL

The invention is related to a fixation member consisting of elastic material. Such fixation member can be used for mounting an object to a frame, in particular for mounting an automotive lamp in a reflector housing. But the fixation member can also be used for any other purpose, whereby an object has to be easily mounted in a predetermined position.

The fixation member can fix an object to another object. Hereinafter that other object will be indicated as frame, but it should be understood that it may be any device to which an object can be mounted.

The object to be mounted can be attached to the fixation member by any means, for example by glue or by mechanical means like a screw. For example, the fixation member can be connected to the cap of an automotive lamp or can be a portion of that cap. Thereby the fixation member keeps the lamp in the correct position and may push the electrical contact elements of the lamp against corresponding electrical contact elements in the reflector housing in which the lamp is to be mounted.

In such fixation member a number of functions can be incorporated. The main function is to prevent the relevant object from moving away from the frame to which it is fixed. Other functions may be to make sure that the object is mounted automatically in an exact predetermined position, that the object is kept in the same position for a longer period, and that the object can easily be demounted from the frame. Furthermore it may be important that the fixation member is simple to operate without making use of tools, that the object can be used again after being demounted, and that the fixation member can be manufactured simple and cheap, preferably from cheap material.

Known fixation members, for example as disclosed in WO99/08346, are composed of several separate parts and are therefore complex and relative expensive to manufacture.

An object of the invention is to provide a fixation member consisting of one piece, which is cheap to produce and which incorporates several functions and advantages.

In order to accomplish that objective, the fixation member comprises a first portion and a second portion interconnected by first spring means, said first portion having first catch means for engaging with the frame to which the fixation member is to be fixed after said first portion is pushed towards said second portion, while said first spring means push said second portion against said frame, and said first portion furthermore having second catch means for engaging with corresponding catch means of said second portion when said first portion is pushed further towards said second portion against an increasing force of said first spring means, whereby said first catch means retract and thereby disengage from the engagement with said frame.

Because the fixation member is divided into two portions interconnected by spring means, the first portion can be positioned independent of the position of the second portion. Therefore the second portion, to which the object to be fixed can be attached, can be positioned in an exact predetermined position and be kept in that position by the force of the spring means, while the position of the first portion is not exactly predetermined but dependent of the functioning of the catch means and the location of engagement with the frame.

The fixation member can be made out of different materials, for example plastic material in which one or more elastic metal parts are present, for example elastic metal strips, to increase the elastic properties of the spring means. Such elastic metal strips can be molded together with the plastic material.

Preferably, the complete fixation member—including the spring means and the catch means—is made out of one piece of elastic material, which may be a cheap plastic material. A better quality plastic (engineering plastic) may be used in case the fixation member has to fix the object for a very long time or in case the fixation member should be reused several times. Glass fibers and the like may reinforce the plastic material.

In one preferred embodiment said second portion is provided with second spring means for abutting against said frame, thereby pushing said second portion in a direction away from said frame. In case the force exerted by said second spring means is smaller then the force exerted by the first spring means, the second spring means will not displace the second portion of the fixation member as long as the second portion is kept in its position by the first spring means, pushing it against the frame. However, after the first catch means are retracted by said further pushing of the first portion, so that the fixation member is released from the frame, said second spring means will push the fixation member away from the frame. That may facilitate the demounting of the object.

Preferably, said first portion is provided with a substantial flat button surface substantial perpendicular with respect to the direction in which said first portion can move relative to said second portion, which button surface can be touched by a finger of a human hand. The button surface of the first portion of the fixation member can be used to push said first portion towards said second portion for tensioning the first spring means and subsequently engage the first catch means with the frame. By further pushing the button surface, said first catch means will retract and disengage from the frame, and subsequently said second catch means will engage with said corresponding catch means of the second portion of the fixation member. So, the button surface facilitates the operation of the fixation member.

In one preferred embodiment said one piece of elastic material substantially extends between two parallel planes, whereby a substantial part of the surface of the fixation member substantially coincides with said planes. The distance between the two planes is preferably between 3 mm and 20 mm, more preferably between 7 mm and 15 mm. Preferably the shape of the fixation member is symmetrical with respect to a central plane perpendicular to said two parallel planes.

In case the fixation member substantially extends between two parallel planes and its surface coincides with these planes or extends perpendicular to these planes, the fixation member of plastic material can easily be molded by a simple mold without inserts.

In one preferred embodiment said first spring means comprise at least two spring elements, whereby one end portion of each spring element is elastically connected to said first portion and the other end portion is elastically connected to said second portion of the fixation member. Preferably, said spring element comprises a slender part between said two end portions to facilitate the elastic movement of said end portions relative to each other. Thereby a linear movement of the first portion relative to the second portion of the fixation member can easily be achieved.

In one preferred embodiment said first catch means comprise at least one—and preferably two—elastically hinging catch elements extending outwardly from said first portion, and said second portion of the fixation member comprises one or more guiding surfaces for contacting said catch elements and for pushing them inwardly when the two said portions of the fixation member are pushed further towards each other into the position whereby the second catch means engage. Thereby said first catch means disengage from the frame, and said first portion and said second portion of the fixation member are fixed to each other in a position whereby said catch elements are kept in an inward position. Thereby the fixation member can be removed from the frame to which it was fixed.

Preferably, said second catch means comprise at least one—and preferably two—elastically hinging catch elements connected to one of said portions of the fixation member, and said corresponding catch means comprise at least one—and preferably two—substantially fixed catch elements connected to the other said portion. Such second catch means can provide for a simple and firm connection between the first portion and the second portion of the fixation member.

In one preferred embodiment said at least one hinging catch element of the second catch means is provided with a protrusion to be touched by hand, so that the second catch means can be easily disengaged, whereby the fixation member will return into its original position because of its elasticity. Subsequently the fixation member can be reused for fixing the same or another object to the same or another frame.

Furthermore the invention is related to a method for fixing an object being attached to a fixation member to a frame, the fixation member consisting of elastic material and comprising a first portion and a second portion interconnected by first spring means, whereby said first portion is connected to the frame by first catch means after said first portion is pushed towards said second portion, while said first spring means push said second portion against said frame, and whereby the object is released from the frame by further pushing said first portion towards said second portion against an increasing force of said first spring means, whereby second catch means of said first portion engage with corresponding catch means of said second portion, and whereby said first catch means retract and thereby disengage from the engagement with said frame.

The invention will be explained in more detail hereinafter by means of a description of an embodiment of a fixation member, in which reference is made to a drawing, in which.

The figures are merely schematic representations of the embodiment, showing the working principle of the fixation member.

Figure 1:
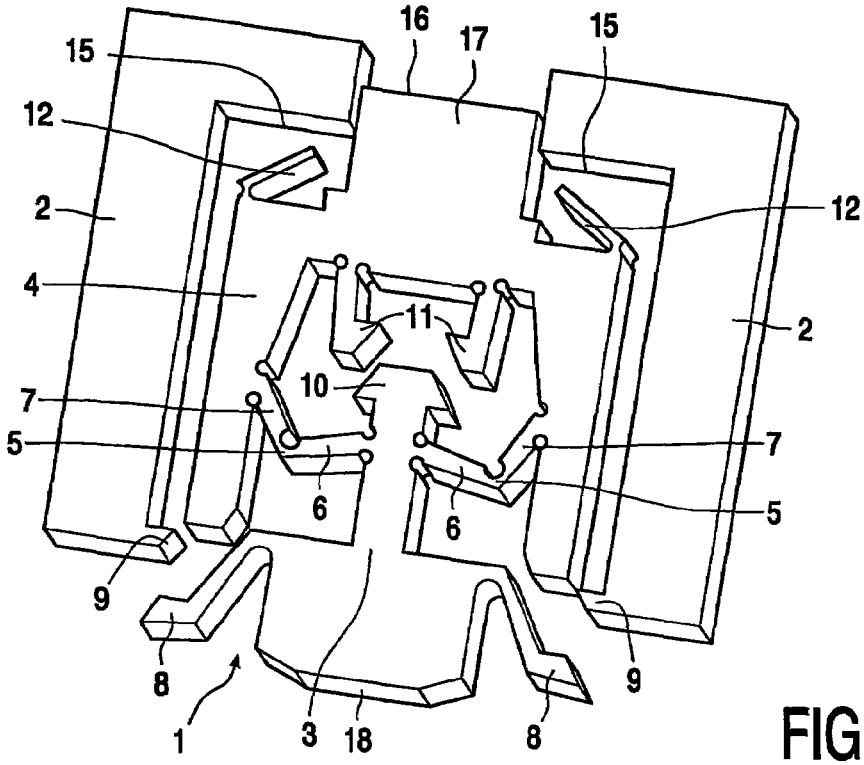
FIG. 1 is a perspective view of a fixation member and a portion of a frame.

FIG. 1 shows the fixation member 1, and a portion of a frame 2 in which an object has to be fixed. The object is not shown in FIG. 1, but can be attached to the fixation member 1. The fixation member 1 is made out of one piece of plastic material, and extends between two flat parallel planes. A substantial portion of the surface of the fixation member 1 coincides with said two parallel planes and the remaining portion of said surface extends perpendicular to said parallel planes, as is shown by the perspective view of FIG. 1. The distance between the two parallel planes is for example between 7 mm and 15 mm and the dimension of the fixation member in a direction parallel to the planes is for example between 30 mm and 70 mm.

FIG. 1 shows the fixation member 1 in a shape in which it is produced, i.e. without any tension in the plastic material. Because the plastic material is elastic, any deformation of the fixation member 1 will cause an elastic force counteracting that deformation.

The fixation member 1 comprises a first portion 3 and a second portion 4. The two portions 3,4 are interconnected by first spring means comprising two spring elements 5. Each spring element 5 is elastically connected to both portions 3,4 of the fixation member 1. Such elastic connection is achieved by applying a slender part of the plastic material between the relevant portion 3,4 and the spring-element 5. A similar slender part is present between the two end portions 6,7 of the spring element 5, so that these two end portions 6,7 can easily elastically move with respect to each other to form the elastic spring member 5.

First portion 3 of fixation member 1 is provided with first catch means 8 for engaging with corresponding catch means 9 of the frame 2. Said first catch means comprise two elastically hinging catch elements 8. Furthermore, first portion 3 is provided with second catch means 10 for engaging with corresponding catch means 11 of the second portion 4 of the fixation member 1. Said second catch means comprises a substantially fixed catch element 10 and said corresponding catch means comprise two elastically hinging catch elements 11.

Second portion 4 of fixation member 1 is furthermore provided with second spring means comprising two elastically hinging parts 12.

To elucidate the cooperation between the fixation member 1 and the frame 2, a small portion of the frame 2 is schematically shown, which portion comprises two catch members 9 forming said corresponding catch means. The presented portion of frame 2 furthermore comprises two surfaces 15 for cooperation with said two elastically hinging parts 12 forming said second spring means, and a recess 16 through which a part 17 of second portion 4 can extend.

FIG. 1 shows the position whereby fixation member 1 is moved into frame 2, whereby second portion 4 of fixation member 1 is passed through the space between the two catch members 9 of said corresponding catch means of frame 2. Thereby said part 17 of second portion 4 extends through recess 16 of the frame 2. To push fixation member 1 into frame 2, first portion 3 of fixation member 1 is provided with a flat button surface 18, which button surface 18 can easily be touched by a finger of a hand.

Figure 2:
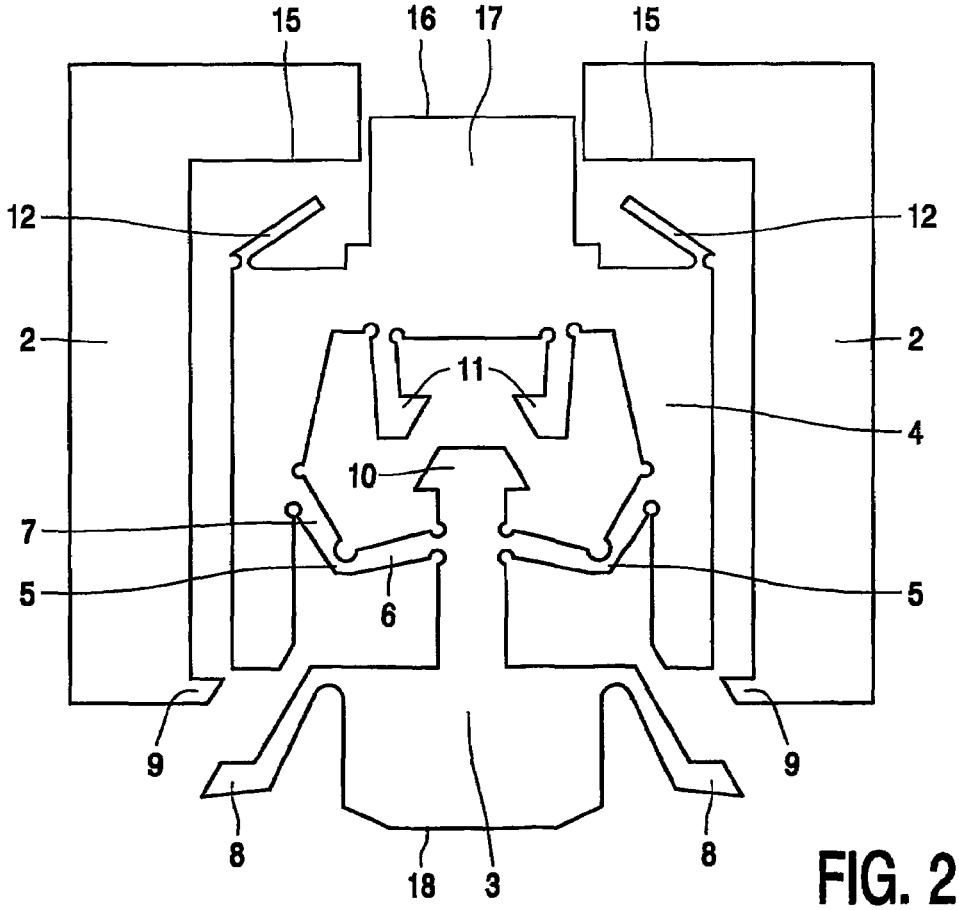
FIG. 2 shows the same fixation member and the portion of the frame.
Figure 3:
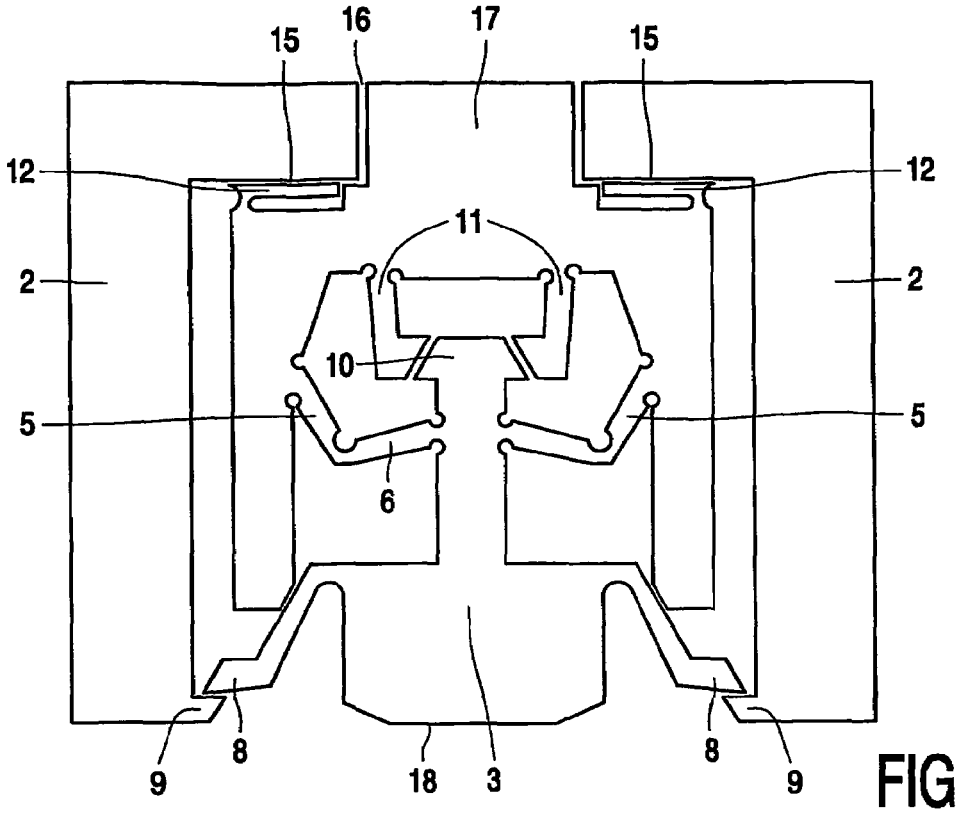
FIG. 3 shows the fixation member in the fixing position.
Figure 4:
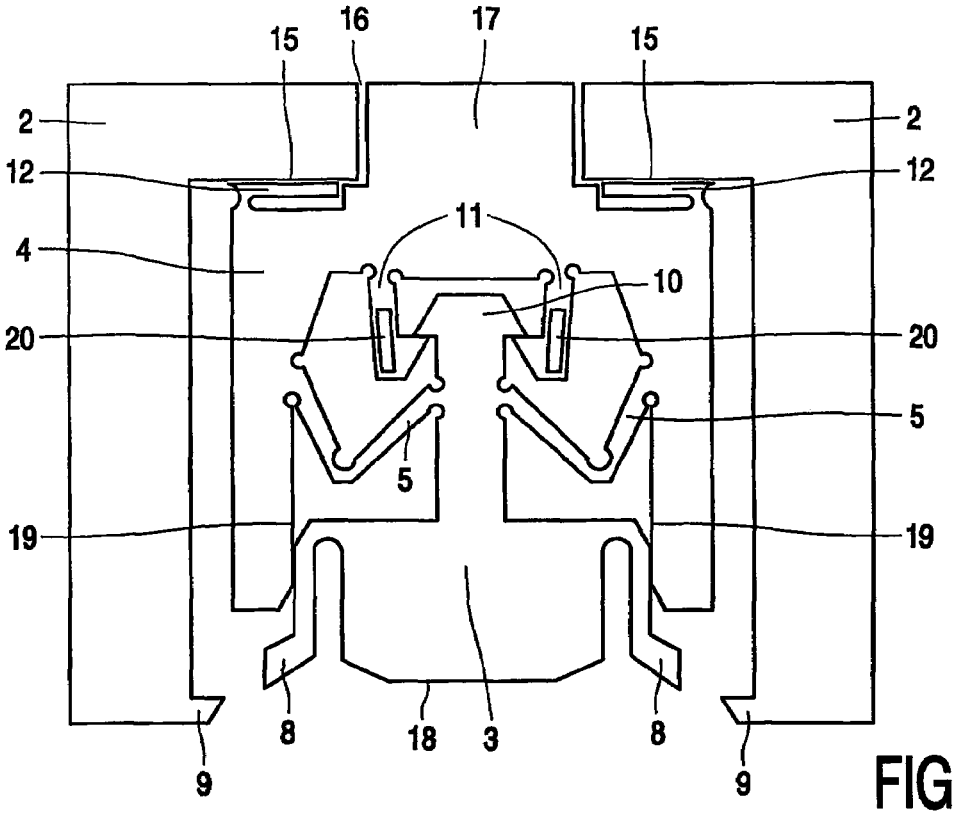
FIG. 4 shows the fixation member in the removable position.

FIGS. 2-4 are views of the fixation member 1 and said portion of the frame 2, whereby said two parallel planes, i.e. parallel portions of the surface of said fixation member, are positioned parallel to the plane of the drawing. These three FIGS. 2-4 show the functioning of the fixation member 1 in subsequent steps.

FIG. 2 shows the same position of fixation member 1 in frame 2 as is shown in FIG. 1, i.e. after second portion 4 of the fixation member 1 is passed through the space between the two catch members 9 of frame 2. The operation for fixing fixation member 1 in frame 2 is as follows.

By pushing on button surface 18 of first portion 4, the two portions 3,4 of fixation member 1 will move towards each other, whereby first spring means 5 will be tensioned. Because the spring force of second spring means 12 is relative low, second portion 4 of fixation member 1 will move forward until the hinging parts 12 are pressed between said surfaces 15 of frame 2 and second portion 4, whereby second portion 4 of fixation member 1 is in its final position. By pushing first portion 3 further forward the tension of first spring means 5 will increase, and first catch means 8 of fixation member 1 will engage with the corresponding catch means 9 of frame 2, as is shown in FIG. 3.

In the fixed position (FIG. 3) second portion 4 of the fixation member 2 can have an exact predetermined position relative to frame 2. In the direction perpendicular to button surface 18 the position of second portion 4 is determined by the location of the two surfaces 15 of frame 2. And in a direction parallel to said button surface 18 the position of second portion 4 is determined by the shape of recess 16 and the corresponding shape of part 17 of second portion 4, and the way both shapes match.

The fixation member can be demounted by pushing the button surface 18 further, so that first portion 3 of fixation member 1 comes closer to second portion 4, as is shown in FIG. 4. Thereby the catch elements 8 will disengage from the catch members 9, because the catch elements 8 are pushed inwardly by guiding surfaces 19 of second portion 4 of fixation member 1. Furthermore, second catch means 10 of first portion 3 will engage with the two elastically hinging catch elements 11 of second portion 4, so that both portions 3,4 of the fixation member 1 are locked together in a position whereby the first catch means 8 are in a retracted position, as is shown in FIG. 4.

FIG. 4 shows the position of fixation member 1 in frame 2 whereby the hinging parts 12 of the second spring means are still pressed between surfaces 15 of the frame 2 and second portion 4. However, after the button surface is released, i.e. no force is exerted on the button surface anymore, the second spring means 12 will push the fixation member 1 away from the surfaces 15, so that the fixation member 1 can be removed easily by hand.

After the fixation member 1 is removed, the second catch means 10 can be disengaged from the corresponding catch means by moving the two elastically hinging catch elements 11 of said corresponding catch means away from each other. Thereby the fixation member 1 will return to its original shape as represented in FIG. 1. After this disengagement the fixation member 1 can be reused for fixing the same or another object to the frame 2 or to another frame.

To facilitate the movement of the two elastically hinging catch elements 11, each of said two catch elements 11 can be provided with a protrusion 20 to be touched by hand. Protrusions 20 are only shown in FIG. 4, and extend perpendicular to the plane of the drawing.

To change or to improve the spring action of the first spring means, the two spring elements 5 may comprise a metal strip, molded in the plastic material. It can be one metal strip extending in both spring elements 5. The two spring elements 5 may also be formed by one or two metal strips, whereby the ends of the strips are fixed in the relevant portions 3,4 of the fixation member 1.

Figure 5:
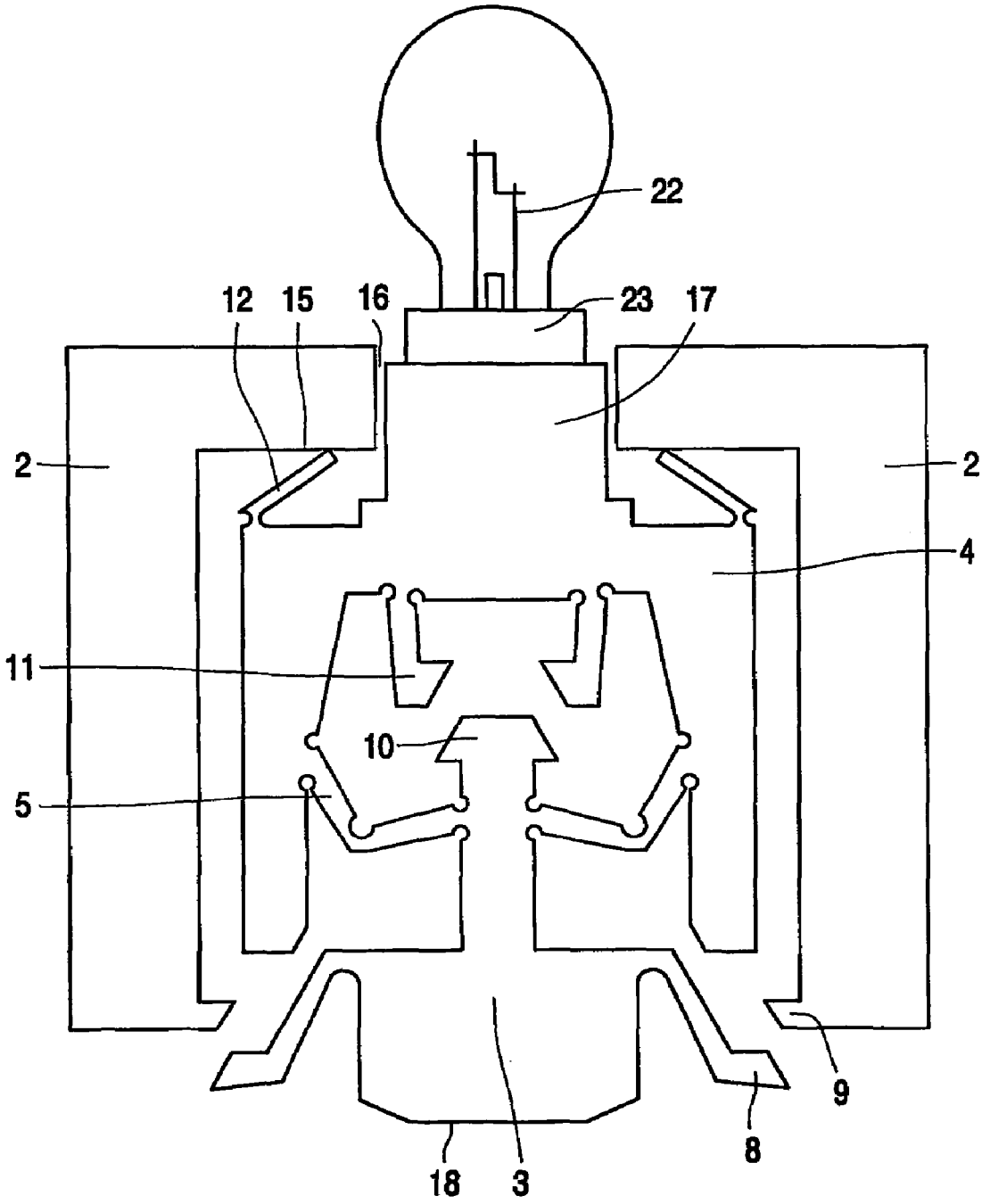
FIG. 5 shows an automotive lamp comprising the fixation member.

FIG. 5 shows the fixation member 1 attached to an automotive lamp 22. The dimension of the lamp 22 is smaller than the recess 16 in the frame 2, so that the lamp 22 can pass through the recess. The frame 2 is a portion of the reflector housing of the lamp 22, which reflector housing is not shown in FIG. 5.

The cap 23 of lamp 22 is attached to part 17 of the second portion 4 of the fixation member 1. The electrical contacts for supplying electric current to the lamp 22 are not shown, but such contacts may be present in the fixation member 1 and in the frame 2, or may be present in a separate electrical connection unit.

By making use of the fixation member 1, the automotive lamp 22 can be fixed in the reflector housing in an exact predetermined position, ensuring an optimal reflection of the light.

The embodiment of the system as described above is merely an example; a great many other embodiments are possible.

The invention claimed is:

1. A fixation member, comprised of elastic material, for mounting an object to a frame, the fixation member comprising:

a first portion and a second portion interconnected by first spring means, said first portion having first catch means and second catch means for respectively engaging said fixation member with said frame and disengaging said fixation member from said frame, said first catch means causing engagement of said fixation member to said frame upon said first portion being pushed towards said second portion, thereby tensioning said first spring means to push said second portion against said frame to subsequently engage said first catch means with said frame, and said second catch means causing disengagement of said fixation member from said frame upon said first portion being pushed further towards said second portion against an increasing tensioning force of said first spring means, whereby said second catch means engages with corresponding catch means of said second portion and said first catch means retracts to subsequently disengage said fixation member from said frame.

2. A fixation member as claimed in claim 1, wherein the fixation member is made of one piece of elastic material.

3. A fixation member as claimed in claim 1, wherein the fixation member is made of plastic material comprising elastic metal parts.

4. A fixation member as claimed in claim 1, wherein said second portion is provided with second spring means for abutting against said frame thereby pushing said second portion in a direction away from said frame.

5. A fixation member as claimed in claim 1, wherein said first portion is provided with a substantial flat button surface substantial perpendicular with respect to the direction in which said first portion can move relative to said second portion, which button surface can be touched by a finger.

6. A fixation member as claimed in claim 1, wherein said elastic material substantially extends between two parallel planes, whereby a substantial part of the surface of the fixation member substantially coincides with said planes.

7. A fixation member as claimed in claim 1, characterized in that said first spring means comprise at least two spring elements, whereby one end portion of each spring element is elastically connected to said first portion and the other end portion is elastically connected to said second portion of the fixation member.

8. A fixation member as claimed in claim 7, wherein each spring element comprises a slender part between said two end portions to facilitate the elastic movement of said end portions relative to each other.

9. A fixation member as claimed in claim 1, wherein said first catch means comprise at least one elastically hinging catch element extending outwardly from said first portion, and in that said second portion of the fixation member comprises a guiding surface for contacting said catch element and for pushing it inwardly when the two said portions are pushed further towards each other into the position whereby the second catch means engage.

10. A fixation member as claimed in claim 1, wherein said second catch means comprise an elastically hinging catch element connected to one of said portions, and in that said corresponding catch means comprise a substantially fixed catch element connected to the other portion of the fixation member.

11. A fixation member as claimed in claim 10, wherein the said hinging catch element is provided with a protrusion to be touched by hand, to disengage the second catch means.

12. A method for fixing an object being attached to a fixation member to a frame, the fixation member comprising elastic material and comprising a first portion and a second portion interconnected by first spring means, whereby said first portion is connected to the frame by first catch means after said first portion is pushed towards said second portion, while said first spring means push said second portion against said frame, and whereby the object is released from the frame by further pushing said first portion towards said second portion against an increasing force of said first spring means, whereby second catch means of said first portion engage with corresponding catch means of said second portion, and whereby said first catch means retract and thereby disengage from the engagement with said frame.

13. An automotive lamp provided with a fixation member, the fixation member being comprised of elastic material, for mounting an object to a frame, the fixation member comprising:

a first portion and a second portion interconnected by first spring means, said first portion having first catch means and second catch means for respectively engaging said fixation member with said frame and disengaging said fixation member from said frame, said first catch means causing engagement of said fixation member to said frame upon said first portion being pushed towards said second portion, thereby tensioning said first spring means to push said second portion against said frame to subsequently engage said first catch means with said frame, and said second catch means causing disengagement of said fixation member from said frame upon said first portion being pushed further towards said second portion against an increasing tensioning force of said first spring means, whereby said second catch means engages with corresponding catch means of said second portion and said first catch means retracts to subsequently disengage said fixation member from said frame.

* * * * *